US010226089B2

(12) United States Patent
Turner

(10) Patent No.: US 10,226,089 B2
(45) Date of Patent: Mar. 12, 2019

(54) INTERCHANGEABLE FASHION ACCESSORY

(71) Applicant: Nichole Turner, Raleigh, NC (US)

(72) Inventor: Nichole Turner, Raleigh, NC (US)

( * ) Notice: Subject to any disclaimer, the term of this patent is extended or adjusted under 35 U.S.C. 154(b) by 805 days.

(21) Appl. No.: 14/227,238

(22) Filed: Mar. 27, 2014

(65) Prior Publication Data

US 2015/0089717 A1 Apr. 2, 2015

Related U.S. Application Data

(60) Provisional application No. 61/885,545, filed on Oct. 2, 2013.

(51) Int. Cl.
*A41D 27/08* (2006.01)
*A42B 1/00* (2006.01)

(52) U.S. Cl.
CPC ..... *A41D 27/08* (2013.01); *A42B 1/004* (2013.01); *A41D 2300/30* (2013.01)

(58) Field of Classification Search
CPC ..... A41D 27/08; A41D 2200/10; A41D 2300/30; A41D 2300/326
USPC ..... 2/244, 338
See application file for complete search history.

(56) References Cited

U.S. PATENT DOCUMENTS 1,860,202 A * 5/1932 Reisman ..... A61F 5/03 450/108
1,895,758 A * 1/1933 Goldsmith ..... B65D 75/02 206/388
3,052,937 A * 9/1962 Caparosa ..... A41D 25/027 2/154
3,086,529 A * 4/1963 Munz ..... A61B 17/1322 128/878
3,256,882 A * 6/1966 Huber ..... A61F 13/00 128/DIG. 15
3,298,366 A * 1/1967 Moore ..... A61F 13/148 450/155
3,440,667 A * 4/1969 Dye ..... A41F 9/002 2/325
3,442,270 A * 5/1969 Steinman ..... A61F 13/00021 128/DIG. 15
3,463,147 A * 8/1969 Stubbs ..... A61F 13/062 2/24
3,561,436 A * 2/1971 Gaylord, Jr. ..... A61F 13/143 602/19
3,594,818 A * 7/1971 Planner ..... A41D 13/1209 2/114
3,603,316 A * 9/1971 Lehman ..... A41C 1/08 2/312
3,616,148 A * 10/1971 Edelman ..... A41F 15/005 156/467
3,636,569 A * 1/1972 Nielson ..... A41F 1/02 2/266
3,696,443 A * 10/1972 Taylor ..... A41D 13/1209 2/114

(Continued)

*Primary Examiner* — Clinton T Ostrup
*Assistant Examiner* — Jocelyn Bravo
(74) *Attorney, Agent, or Firm* — Coats & Bennett, PLLC

(57) ABSTRACT

An interchangable fashion accessory is disclosed that may be used with different articles of clothing. In a first configuration, the fashion accessory may be worn around a user's waist to provide a different appearance for a dress. In a second configuration, the fashion accessory may be secured around a hat or other article of headwear.

6 Claims, 3 Drawing Sheets

(56) References Cited

U.S. PATENT DOCUMENTS 3,718,143 A * 2/1973 Pagano ..... A41C 3/00 450/75
3,848,270 A * 11/1974 Rand ..... A41F 9/002 2/311
3,873,403 A * 3/1975 Edelman ..... A41F 15/005 2/338
3,896,818 A * 7/1975 Locascio ..... A41C 3/00 450/70
3,898,119 A * 8/1975 Barr ..... B60R 22/18 112/470.33
4,047,651 A * 9/1977 McMullen ..... A44C 5/0053 2/338
4,134,154 A * 1/1979 Faulkner ..... A41F 9/002 2/338
4,259,749 A * 4/1981 Krug ..... A41D 27/08 2/244
4,289,820 A * 9/1981 Blessing ..... A41D 27/245 156/202
4,339,059 A * 7/1982 Kenyon ..... D04D 7/10 2/151
4,370,978 A * 2/1983 Palumbo ..... A61F 13/062 602/26
4,384,583 A * 5/1983 Speelman ..... A61B 17/1322 2/338
4,472,839 A * 9/1984 Johansen ..... A41F 9/002 128/DIG. 15
4,527,566 A * 7/1985 Abare ..... A61F 7/02 601/15
4,787,381 A * 11/1988 Hubbard ..... A61F 13/148 139/421
4,849,863 A * 7/1989 Gallegos ..... A41D 13/01 2/11
4,991,234 A * 2/1991 Greenberg ..... A41D 20/00 2/16
4,999,853 A * 3/1991 Tanner ..... A41F 9/002 2/321
5,107,827 A * 4/1992 Boyd ..... A61D 9/00 602/58
5,299,325 A * 4/1994 Kamber ..... A41F 9/002 2/338
5,528,771 A * 6/1996 Yudin ..... A61F 5/028 128/112.1
5,539,933 A * 7/1996 Garber ..... A41F 9/002 2/311
5,586,969 A * 12/1996 Yewer, Jr. ..... A61F 5/028 128/101.1
5,921,949 A * 7/1999 Dray ..... A61F 5/0118 2/162
6,135,853 A * 10/2000 Hopson ..... A41F 15/02 2/323
6,149,666 A * 11/2000 Marsden ..... A61B 17/1322 606/203
6,339,848 B1 * 1/2002 Mayhood ..... A41F 9/002 2/338
6,532,600 B2 * 3/2003 Brignoli ..... A41F 9/002 2/311
6,545,193 B1 * 4/2003 Morgenstern ..... A61F 13/0273 128/876
6,687,916 B2 * 2/2004 Thompson ..... A44C 5/0007 2/16
6,755,799 B2 * 6/2004 Toda ..... A61F 5/028 2/311
6,996,855 B1 * 2/2006 Dandrea ..... A41F 9/002 2/338
7,329,232 B2 * 2/2008 Lipshaw ..... A61F 13/06 128/845
7,663,015 B2 * 2/2010 Johnson ..... A61F 13/00 128/888
7,752,678 B1 * 7/2010 Wilson ..... A63B 71/1225 2/22
7,785,171 B1 * 8/2010 Baker ..... A41F 15/02 2/338
D624,246 S * 9/2010 Houtz ..... A61F 13/00 D29/120.1
7,927,179 B2 * 4/2011 Kaye ..... A41F 15/02 450/86
8,221,188 B2 * 7/2012 Liu ..... A41C 3/02 450/62
8,341,764 B1 * 1/2013 Wilson ..... A63B 71/1225 2/22
8,808,213 B2 * 8/2014 Hendricks ..... A61F 5/028 602/19
2009/0191789 A1 * 7/2009 Knox ..... A41C 3/00 450/8
2009/0233522 A1 * 9/2009 Schlatmann ..... A41C 3/0057 450/39
2010/0257658 A1 * 10/2010 Schwietz-Flauto .... A41D 27/08 2/207
2013/0152278 A1 * 6/2013 Machado ..... A41F 9/00 2/311
2014/0068839 A1 * 3/2014 Steele ..... A61F 13/64 2/338

* cited by examiner

INTERCHANGEABLE FASHION ACCESSORY

TECHNICAL FIELD

The present invention relates generally to fashion accessories to enhance or individualize clothing or other items and, more particularly to a multi-functional accessory that can be interchangeably secured around a person's waist or used to accessorize headwear.

BACKGROUND

It is often desirable to wear accessories with articles of clothing to give the clothing a different appearance. For example, a dress can be worn with an accessory to provide a different appearance. Accessories also enable a person to "dress up" casual clothing to provide a more elegant appearance. Thus, accessories enable a person to extend their wardrobe without having to invest in expensive items of clothing.

Typically, different accessories are used to accessorize different articles of clothing. For example, one accessory may be used to change the appearance of a dress, while a different accessory is used with headwear. An accessory that can be used with different clothing articles would enable a person to achieve a variety of different looks with only a small investment in the accessory.

SUMMARY

The present invention comprises an interchangeable fashion accessory that may be used with different articles of clothing. The fashion accessory comprises an elongated band and a bow secured to the elongated band. The elongated band is capable of being disposed in a generally flat configuration or in a folded configuration. A first set of fasteners is disposed on the elongated band adjacent the first end. A second set of fasteners is disposed on the elongated band adjacent the second end for engagement with the first set of fasteners while the band is in the flat configuration to secure the band around a user's waist. A third set of fasteners is disposed on the elongated band for engagement with the first set of fasteners while the band is in the folded configuration to secure the band around an article of headwear.

The fashion accessory may be used with different clothing articles to achieve a variety of different looks without a large investment in clothing.

DETAILED DESCRIPTION

Figure 3:
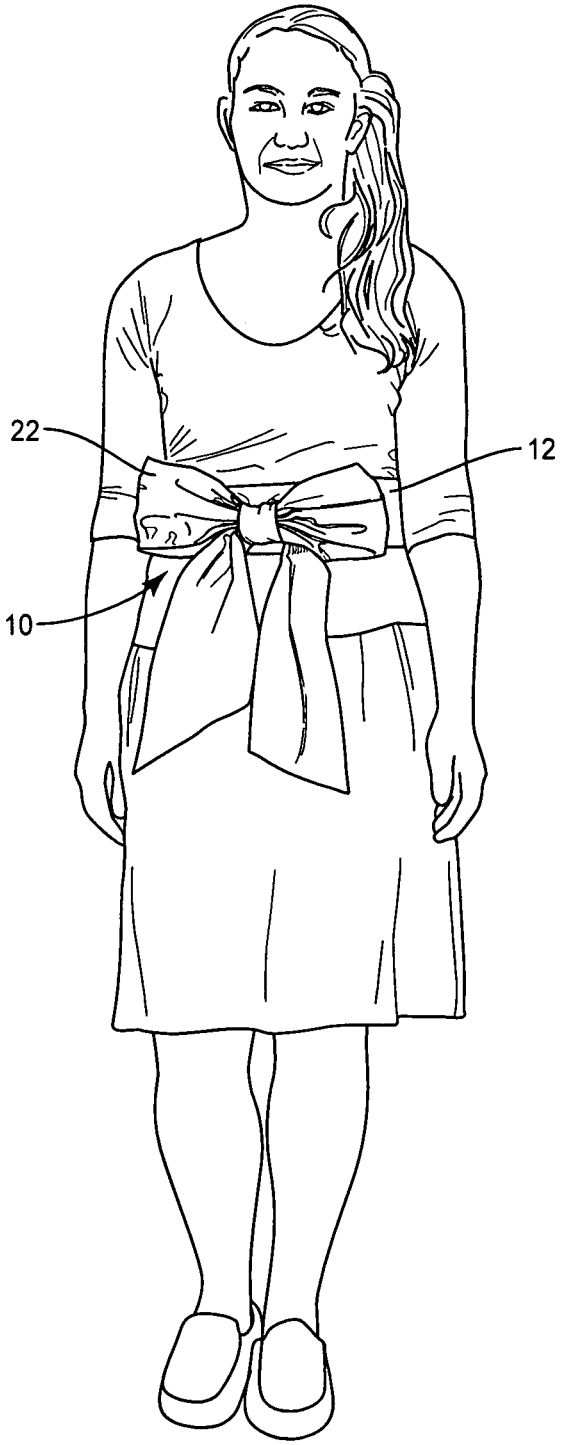
FIG. 3 illustrates the fashion accessory worn around a person's waist.
Figure 6:
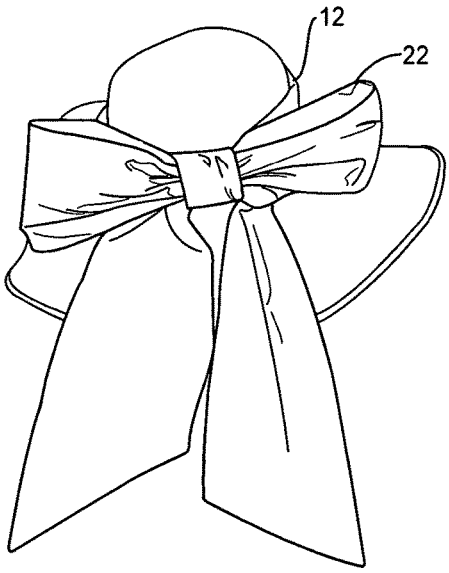
FIG. 6 illustrates the fashion accessory secured around an article of headwear.

Referring now to the drawings, a fashion accessory according to one embodiment of the invention is shown therein and indicated generally by the numeral 10. As will be hereinafter described in greater detail, the fashion accessory 10 may be used in a generally flat configuration, or in a folded configuration. In the flat configuration, the fashion accessory 10 may be worn around a user's waist as shown in FIG. 3. In the folded configuration, the accessory 10 may be secured around a hat or other article of headwear as shown in FIG. 6.

Figure 1:
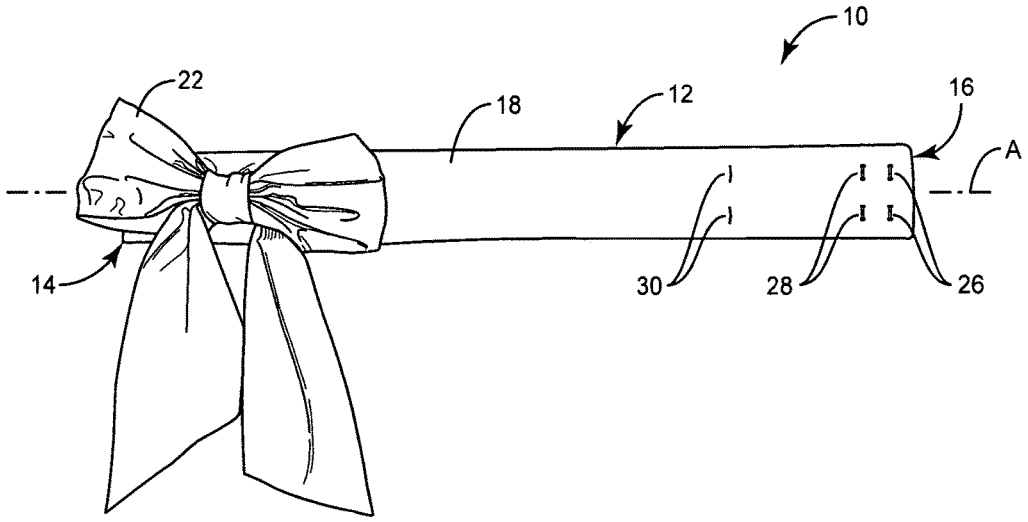
FIG. 1 illustrates a front view of a fashion accessory according to one embodiment of the disclosure.
Figure 2:
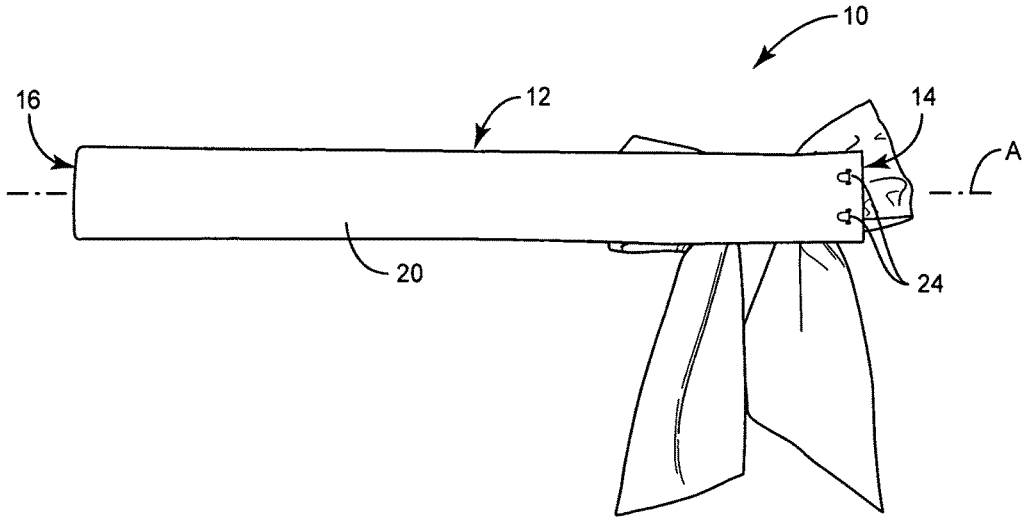
FIG. 2 illustrates a back view of the fashion accessory.

FIGS. 1 and 2 illustrate the fashion accessory 10 in the flat configuration. The fashion accessory 10 comprises an elongated band 12, and a bow 22 secured to the elongated band 12. The elongated band 12 comprises a first end 14, a second end 16, an outside surface 18 and an inside surface 20. The bow 22 is secured to the outside surface 18 of the elongated band 12 by any suitable means, such as by stitching. In some embodiments, the bow 22 may be detachable so that different bows 22 may be used with a single band 12. The detachable bow 22 may be secured by any suitable fastener, such as a snap fastener or hook and loop fastener (e.g. VELCRO®).

In one exemplary embodiment, the elongated band 12 and bow 22 are made of fabric, although other materials could also be used. The elongated band 12 may comprise two plies of material that are sewn along the edges of the elongated band 12. Alternatively, the elongated band 12 may be made of a single ply that is folded in half and then sewn along the edges.

As best seen in FIG. 2, a pair of hook fasteners 24 are disposed on the inside surface 20 of the elongated band 12 adjacent the first end 14. A first pair of eye fasteners 26 are disposed on the outside surface 18 of the elongated band 12 adjacent the second end 16 (FIG. 1). The first pair of eye fasteners 26 may be engaged by the hook fasteners 24 while the elongated band 12 is in a flat configuration to secure the elongated band 12 around a user's waist as shown in FIG. 3.

A second pair of eye fasteners 28 is disposed on the outside surface 18 of the elongated band 12 adjacent the second end 16. The second pair of eye fasteners 28 may likewise be engaged by the hook fasteners 24 to secure the elongated band 12 around a user's waist. The two pairs of eye fasteners 26 and 28 enable the elongated band 12 to fit persons with different waist sizes. Those skilled-in-the-art will appreciate that additional eye fasteners could also be provided.

A pair of tacks 30 are disposed on the outside surface 18 of the elongated band 12 between the second end 16 and the center of the elongated band 12. The tacks 30 are formed by loose stitches made with thread. In one exemplary embodiment, the thread is the same color as the elongated band 12 so that the tacks 30 will not stand out visually. As will be hereinafter explained in greater detail, the tacks 30 may be engaged by the hook fasteners 24 to secure the elongated band 12 around a hat or other article of headwear while the elongated band 12 is in a folded configuration.

In use, the elongated band 12 in the flat configuration may be disposed around a person's waist with the first and second ends 14 and 16 overlapped. The hook fasteners 24 may be engaged with either the first pair of eye fasteners 26 or the second pair of eye fasteners 28 to secure the fashion accessory 10 around a person's waist as shown in FIG. 3.

Figure 4:
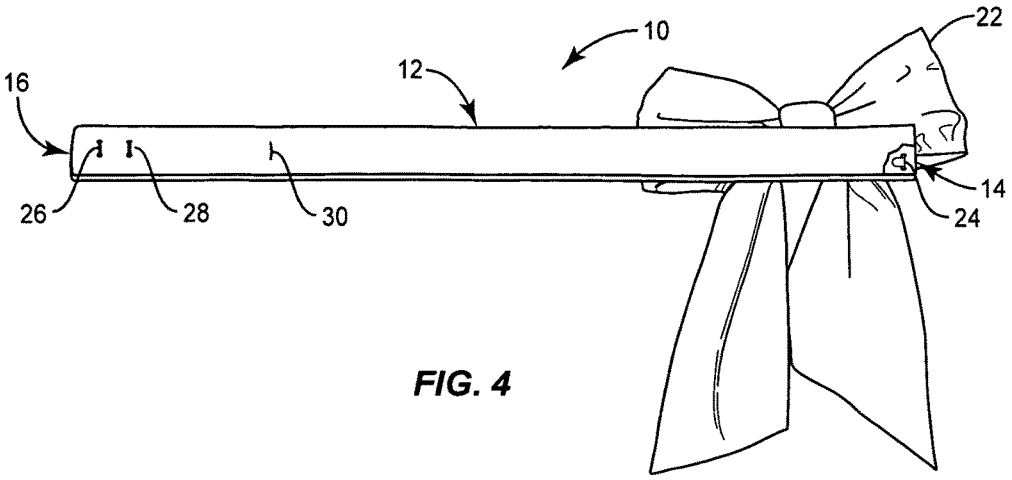
FIG. 4 illustrates the fashion accessory folded along a longitudinal axis.
Figure 5:
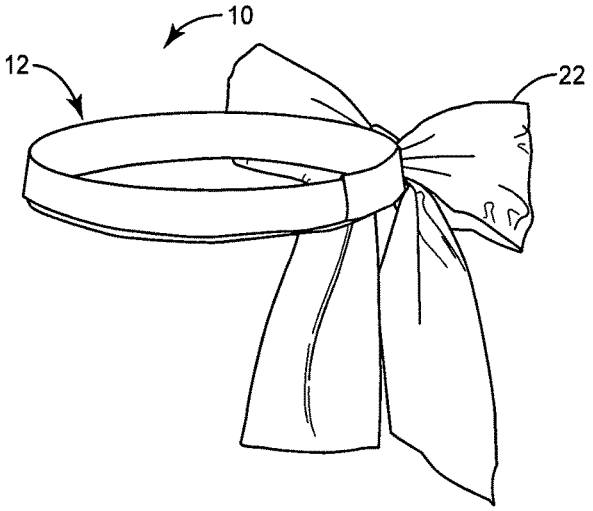
FIG. 5 illustrates the fashion accessory folded along a longitudinal axis and with the ends secured to form a loop.

Alternatively, the fashion accessory 10 may be used in a folded configuration as shown in FIG. 4. In the folded configuration, the elongated band 12 is folded in half along its longitudinal axis A. The fold line extends between each pair of fasteners 24, 26, and 28. To secure the elongated band 12 around a hat, the first and second ends 14 and 16 are overlapped with the second end 16 nested inside the folded first end 14 to conceal the eye fasteners 26 and 28. The first and second ends 14 and 16 are secured together by engaging the hook fasteners 24 with the tacks 30. In this configuration, the band 12 can be secured around a hat or other article of headwear as shown in FIG. 6.

Although one embodiment of the invention has been described, those skilled in the art will appreciate that numerous variations are possible. For example, the hook and eye fasteners in the disclosed embodiment could be replaced with other types of fasteners, such as snap fasteners, or hook and loop (e.g. VELCRO® fasteners). Also, in some embodiments, the bow 22 may be replaced with other decorative elements.

What is claimed is:

1. A fashion accessory comprising:

an elongated band having first and second ends, said elongated band configured to be worn in a generally flat configuration and a folded configuration in which the elongated band is folded along a longitudinal axis;

a first set of fasteners disposed on an inside surface of the elongated band adjacent the first end;

a second set of fasteners disposed on an outside surface of the elongated band adjacent the second end for engagement with the first set of fasteners while the band is in the flat configuration to secure the band around a user's waist;

a third set of fasteners disposed on the outside surface of the elongated band and spaced from the second set of fasteners for engagement with the first set of fasteners while the band is in the folded configuration to secure the band around an article of headwear; and a decorative bow attached to an outside surface of the band.

2. The fashion accessory of claim 1 wherein, in the folded configuration, the first set of fasteners is disposed on an inside of the fold, and the second and third sets of fasteners are disposed on an outside of the fold.

3. The fashion accessory of claim 2 wherein, in the folded configuration, the first and second ends of the elongated bands are configured to be overlapped with the folded second end nested inside of the folded first end.

4. The fashion accessory of claim 3 wherein, in the folded configuration, the first end of the elongated band covers the second and third sets of fasteners.

5. The fashion accessory of claim 1 wherein the first set of fasteners comprises hooks disposed on opposite sides of the longitudinal axis.

6. The fashion accessory of claim 5 wherein the second and third sets of fasteners comprise loops disposed on opposite sides of the longitudinal axis.

* * * * *